US006097345A

United States Patent [19]

Walton

[11] Patent Number: 6,097,345

[45] Date of Patent: Aug. 1, 2000

[54] DUAL BAND ANTENNA FOR VEHICLES

[75] Inventor: Eric K. Walton, Columbus, Ohio

[73] Assignee: The Ohio State University, Columbus, Ohio

[21] Appl. No.: 09/185,289

[22] Filed: Nov. 3, 1998

[51] Int. Cl.[7] ..... H01Q 1/48

[52] U.S. Cl. ..... 343/769; 343/713; 343/711; 343/700 MS

[58] Field of Search ..... 343/700 MS, 713, 343/767, 770, 769, 711, 789

[56] References Cited

U.S. PATENT DOCUMENTS 2,508,085 5/1950 Alford ..... 343/770
4,063,246 12/1977 Greiser ..... 343/700 MS

*Primary Examiner*—Don Wong
*Assistant Examiner*—James Clinger
*Attorney, Agent, or Firm*—Frank H. Foster; Kremblas, Foster, Millard & Pollick

[57] ABSTRACT

A dual band slot antenna for cellular telephone and GPS frequency bands. The antenna is a slot antenna formed in a conductive layer laminated to a layer of a windshield or other transparency. The slot is formed along two adjoining arcs of a circle extending oppositely from a feedpoint, with a portion of the conductive layer interposed between the ends of the slots. The two slot legs have different lengths so the slot is tuned to exhibit at least two resonant peaks, such as one at the cellular telephone frequency band and the other at the GPS frequency band. The slot is fed by strip line transmission lines or capacitive coupling, using additional conductive film patches spaced by one or more layers of the window, with the window layer forming a dielectric.

19 Claims, 8 Drawing Sheets

DUAL BAND ANTENNA FOR VEHICLES

BACKGROUND OF THE INVENTION

1. Field of the Invention

This invention relates generally to vehicle-mounted, radio frequency antennas for use in communications and navigation, and more particularly is directed to an antenna which is incorporated into a vehicle windshield or other transparency or body panel and is operable at two different frequency bands such as in both the cellular telephone frequency band and the global positioning system (GPS) frequency band.

2. Description of the Related Art

Vehicle mounted antennas which are formed integrally in an automobile windshield or other transparency have long been used for AM and FM radio reception. Such antennas offer the advantages of low cost and an effective antenna which does not protrude from the vehicle, and consequently is not unsightly or subject to breaking. Such antennas have traditionally been formed by laminating wires or ribbon conductors of metallic film between layers of vehicle windshield glass or by additional conductors bonded to the surface of a transparency, such as the use of silver ceramic on tempered transparencies.

Growth in the use of cellular telephones and anticipated growth of electronic navigation equipment utilizing the satellites of the global positioning system have created a need for additional vehicle mounted antennas to serve the frequency bands of these systems. Traditionally, each of these systems has operated with its own discrete antenna mounted to and protruding from the exterior of a vehicle or, for portable systems, incorporated in the electronic equipment itself. Protruding cellular and GPS antennas provide good signal strength and, importantly for GPS, a wide-angle view of the sky, but create the same problems associated with protruding broadcast band antennas. Antennas mounted integrally with the electronic equipment when used from inside a vehicle provide reduced signal strength as a result of the vehicle body interposing a transmission barrier.

There is therefore a need for cellular telephone and GPS antennas which can be mounted to a surface of the vehicle, but do not protrude from the exterior of he vehicle or into its interior passenger compartment.

There is also a need for such antennas which can be inexpensively manufactured so they can be incorporated as standard equipment on all vehicles.

There is a further need for such antennas which do not alter the aesthetic or cosmetic appearance of the automobile and which require only minimal modification of existing window structures and manufacturing processes.

There is additionally a need for a single antenna of the type described above which can be used simultaneously for both cellular telephones and GPS and also exhibits a sufficiently high signal strength characteristic and gain pattern characteristics, so that it is a competitive substitute for existing, externally mounted, protruding antennas. Those characteristics are that the antennas be azimuthally omnidirectional and vertically polarized for cellular telephones and have a skyward looking, circularly polarized, horizon-to-horizon hemispheric pattern for GPS.

SUMMARY OF THE INVENTION

The invention is a dual band slot antenna formed in a conductive layer or sheet and having two slot legs extending in transverse directions from a feed point, and preferably extending along two adjoining arcs of a circle extending oppositely from the feed point with a portion of the conductive layer or sheet interposed between the slot leg ends. The slot is tuned to have a resonant peak in each of two different frequency bands, such as in the frequency band for the global positioning system, and in the cellular telephone frequency band to provide a vertically polarized, omnidirectional antenna at the cellular telephone frequencies and a circularly polarized, horizon to horizon viewing antenna at the GPS frequencies. Preferably, the conductive sheet is an electrically conductive layer bonded to a nonconductive panel, such as a vehicle transparency, exterior body panel or interior panel.

Figure 1:
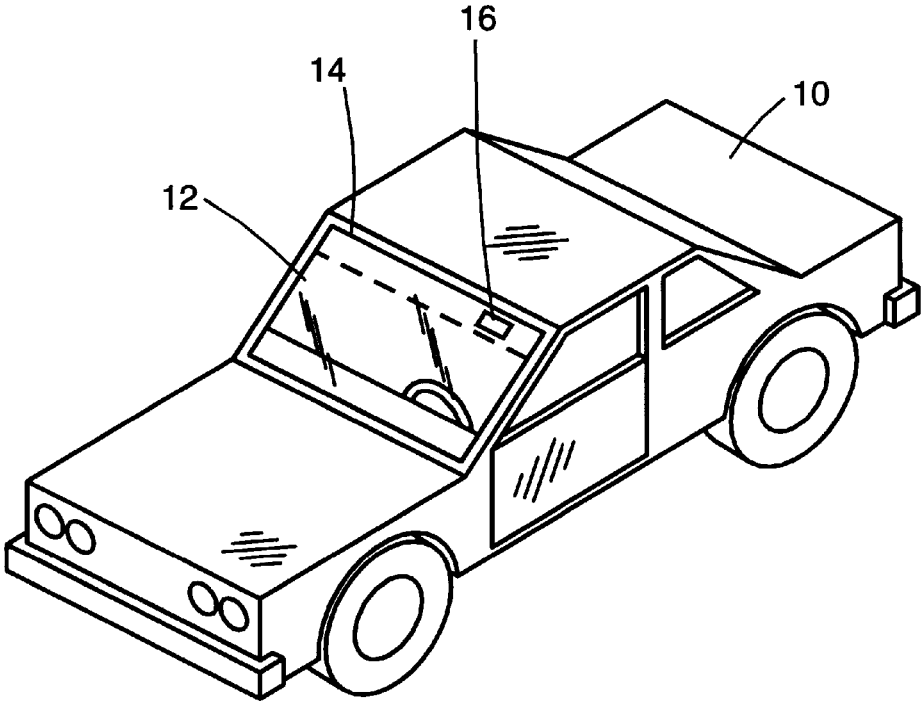
FIG. 1 is a view in perspective of a vehicle having an antenna embodying the present invention formed within its windshield.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

FIG. 1 illustrates a vehicle 10 having a windshield 12 including a darkened fade band 14 extending horizontally across its top. An antenna 16, embodying the present invention, is formed in the windshield 12 and preferably in the fade band 14 for minimizing its visibility.

Figure 2:
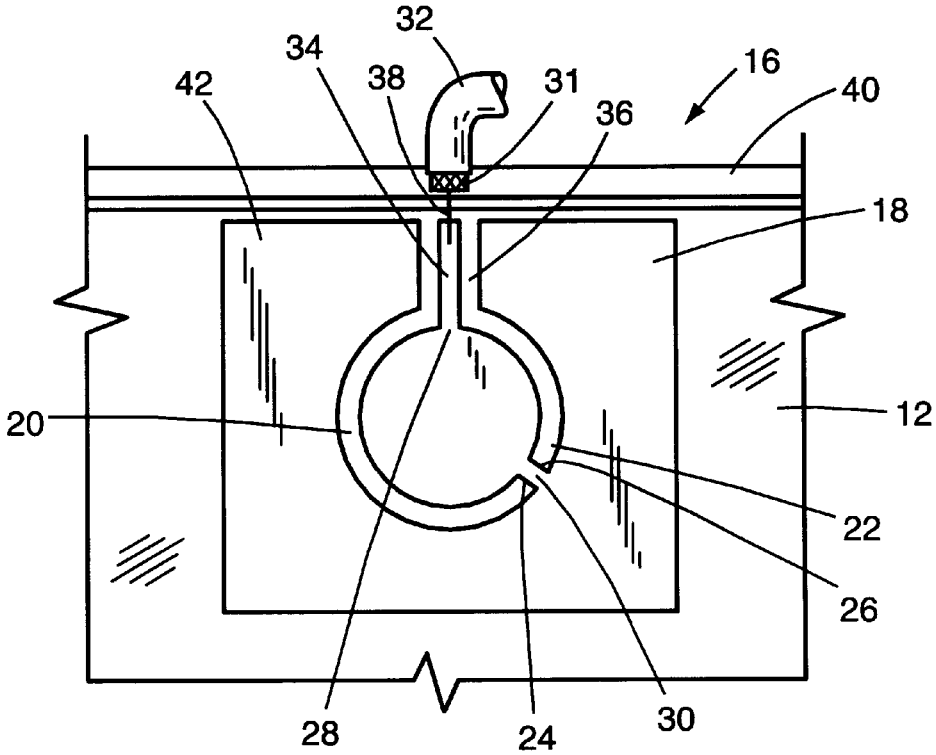
FIGS. 2, 3 and 4 are plan views of a segment of a vehicle windshield illustrating alternative embodiments of the invention.

FIG. 2 illustrates in detail the antenna 16. The antenna of the present invention is a slot antenna formed of an electrically conductive layer 18 of transparent, conductive film bonded, for example, in an interface between layers of the window 12. This thin, metal layer may be formed in the same manner as metal thin layers or films are currently formed in windshields for forming AM/FM antennas, infrared reflection and window defrosting resistive heating elements. Although the figures illustrate a separate or discrete square of a transparent conductive layer, the slot antenna of the invention may be formed in a layer which extends further, including as far as the limits of the windshield or other transparency.

The conductive layer in which the antenna slot is formed may be implemented a many different ways which are given by way of example. The conductive layer may be a conductive paint, a metal film deposited by sputtering or vapor deposition, a screen mesh or a discrete film which is adhered to a nonconductive panel. Furthermore, the conductive layer may be formed on the exterior surface of a transparency, such as a tempered glass window, on an interior surface of any one of the multiple glass or plastic layers of a laminated transparency, or bonded on a surface of or molded or embedded into a composite body panel, such as fiberglass, or interior panel. The slot antenna may also be implemented by forming it in a metal sheet such as a metal body panel of a vehicle, illustrated in FIG. 11 and described below.

The slot of the antenna has two slot legs 20 and 22 extending in transverse directions from a feedpoint 28 to slot leg ends 24 and 26. The legs 20 and 22 extend different lengths and provide the antenna with resonance at two different frequency bands. Preferably, the legs are formed along two adjoining arcs of a circle, extending oppositely from the feedpoint 28, leaving a segment 30 of conductive layer interposed between the slot ends 24 and 26. Inasmuch as the antenna is preferably formed in a vehicle window, there is no ground plane behind the slot.

For use with the preferred frequency bands, the two legs 20 and 22 are tuned to a primary resonance at the GPS frequency band, namely 1,575.42 MHz. The two legs are also tuned to and provide vertical polarization at the cellular telephone frequency band, 824–894 MHz, while simultaneously providing resonance at the GPS frequency band. Two different modes are set up in the antenna so that the longer slot leg 20, together with the shorter slot leg 22, provide cross polarized components with a 90° phase shift needed to obtain a circularly polarized antenna at the GPS frequency band.

The antenna dimensions are selected for a particular pair of resonant bands by applying known equations and parameters known to those skilled in the antenna art, and which have been previously used for the design of conventional dual-band slot antennas. For example, the known design equations for the design of the complementary antenna can be used for a slot embodying the invention. A complementary antenna, sometimes referred to a a dual, is a metallic conductor shaped like the slot and fed with a voltage instead of a current, i.e. the feed is tuned to present a voltage node to the complement's metallic conductor instead of a current node which is presented to a slot. The complementary antenna is therefore an arcuate metallic conductor with a gap at the off center feed point and the design equations for complements are known and can be used by those skilled in the art to design the slot to exhibit the desired resonant peaks. See, for example, *Antennas* by John Kraus, McGraw-Hill, 1950, New York, Section 13–3.

Although the two conductors of a transmission line connected to the electronic circuitry, which is usually a coaxial cable, may be directly conductively connected to the ground plane and feedpoint of the slot antenna, such connections can require physically difficult or expensive manufacturing operations necessitated by the need to drill holes through layers of the window, notch one of the plys of a two-ply glass panel or provide terminal strips. The slot antenna structure of the present invention facilitates the use of capacitive coupling because the slot antenna comprises nearly planar sheets having substantial area for forming an electrode of a capacitor.

The antenna 16 of FIG. 2 is fed from a coaxial cable 32 by a planar strip transmission line, formed by a strip 34 of transparent conductive film bonded in the same interface, i.e. between the same layers of the window, where the conductive layer having the slot is located. The strip 34 extends outwardly from an interior edge of the slot at the feedpoint 28 along and spaced within a linear gap 36 in the conductive sheet 18 into conductive connection to the central conductor 38 of the coaxial cable 32. This conductive connection may be accomplished, for example, by conventional soldering or use of conductive adhesive.

The surrounding, outer conductive shield 31 of the coaxial cable 32 may be directly connected in the conventional manner to the conductive layer 18 and to the metal chassis of the auto. Alternatively, however, the conductive layer 18 may be capacitively coupled to the shield 31 of the coaxial cable 32, which is the grounded side of the coaxial cable 32. Although a variety of capacitive coupling structures may be used, one desirable capacitive coupling is accomplished by forming the conductive layer 18 so that it is spaced from the surrounding metal window bezel 40, which forms a frame around the window, to provide a distributed capacitance between the edge region 42 of the conductive layer 18 and the window bezel 40. The grounded cable shield 31 is conductively connected to the window bezel 40 and the distributed capacitance forms the capacitive coupling between the grounded shield 31 of the coaxial cable 32 and the conductive layer 18.

Figure 3:
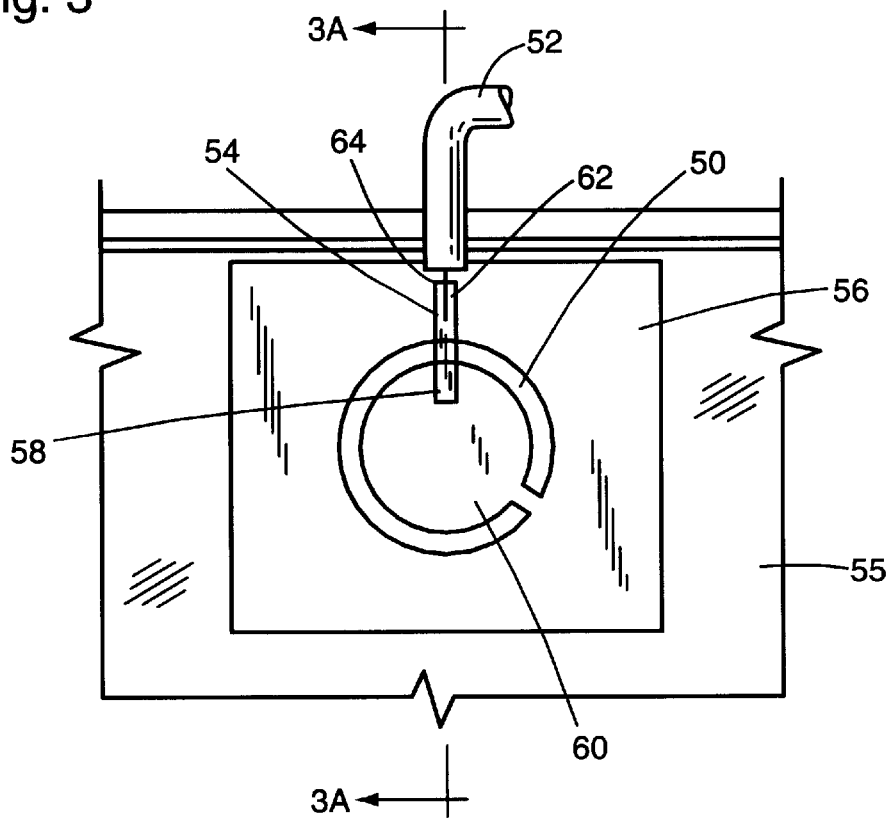
Figure 3A:
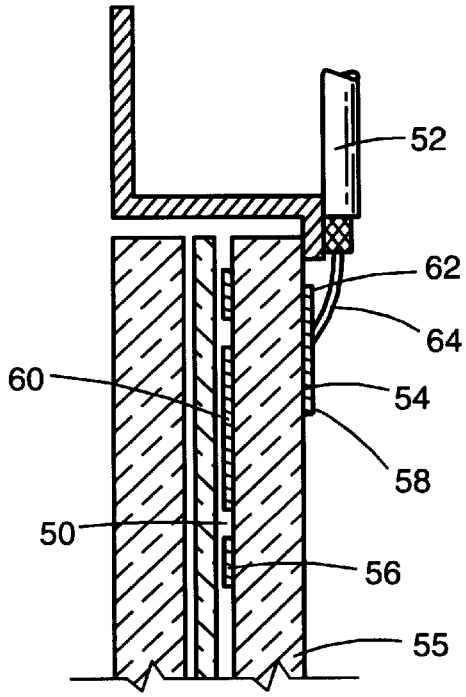
FIG. 3A is a view in cross section of the antenna illustrated in FIG. 3 taken substantially along the line 3A—3A of FIG. 3.

FIGS. 3 and 3A illustrate a slot antenna having a slot 50 and constructed identically to the slot antenna of FIG. 2. FIG. 3A, like FIG. 4A, is shown somewhat exploded and exaggerated in thickness for illustration purposes in order to make the various components visible. However, the slot 50 is fed differently from a coaxial cable 52. In particular, a strip 54 of conductive film is bonded to a layer of the window 55, but in a different interface than the interface which contains the conductive layer 56 in which the antenna slot 50 is formed. While the strip 54 can be formed on an outer or inner surface, it will then require a protective coating to prevent oxidation of the strip so that it still is formed in an interface. The strip 54 forms a strip line transmission line with the interposed window glass or plastic layer or layers forming the dielectric of the transmission line. The strip 54 extends from a position 58 spaced from and capacitively coupled to the interior, conductive portion 60 of the conductive layer 56 forming the slot 50, outwardly to an end 62 at which it may be conductively connected to the central conductor 64 of the coaxial cable 52.

Figure 4:
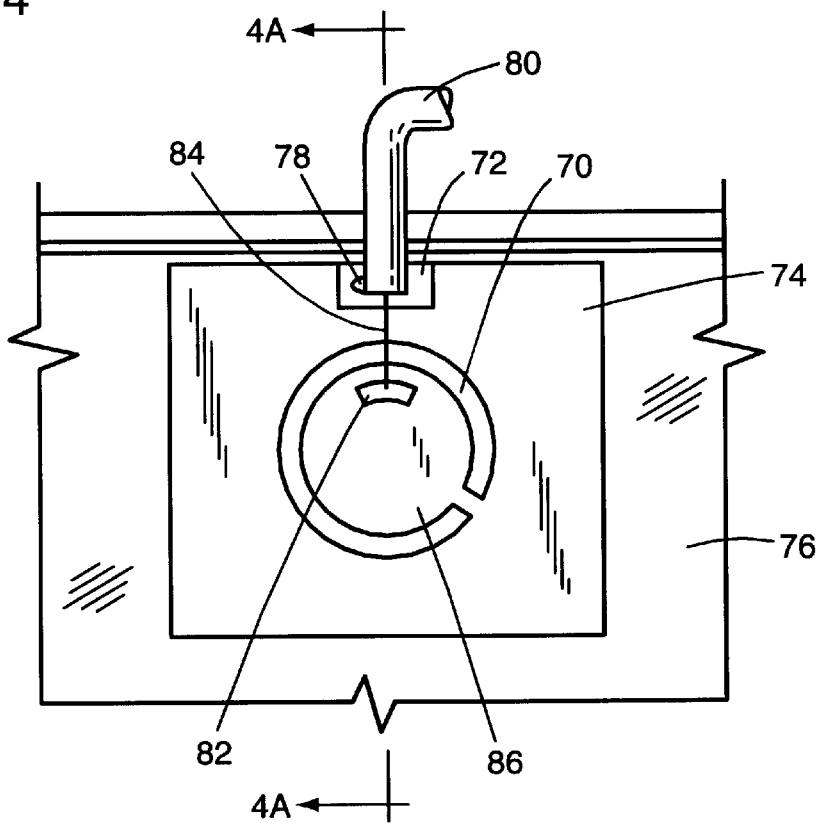
Figure 4A:
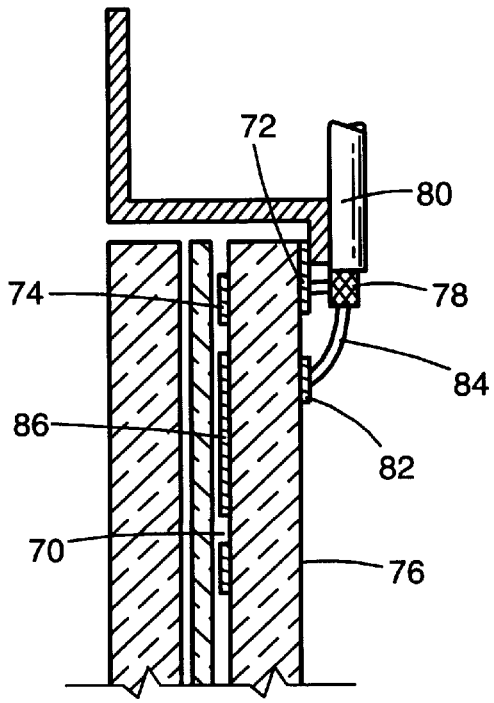
FIG. 4A is a view in cross section of the antenna illustrated in FIG. 4 taken substantially along the line 4A—4A of FIG. 4.

FIG. 4 illustrates an antenna having a slot 70 formed in a conductive layer 74 like the previously illustrated slots, but fed still differently and entirely by capacitive coupling. A conductive patch 72 is bonded to a layer of a window 76, but not in the interface which contains the transparent conductive layer 74 so that one or more layers of the window 76 forms a dielectric between the conductive sheet 74 and the patch 72 to form a capacitor. The patch 72 is conductively connected to the end 78 of the grounded shield of a coaxial cable 80.

Similarly, a second patch 82 of conductive film is also bonded to a layer of the window 76 and not in the interface in which the conductive layer 74 is formed. Preferably, the second patch 82 is formed at the same interface as the patch 72. The patch 82 consequently is separated from the transparent, conductive layer 74 by the dielectric window layer to form a capacitive coupling between the central conductor 84 of the transmission line 80 and the center portion 86 of the conductive layer 74.

Figure 5:
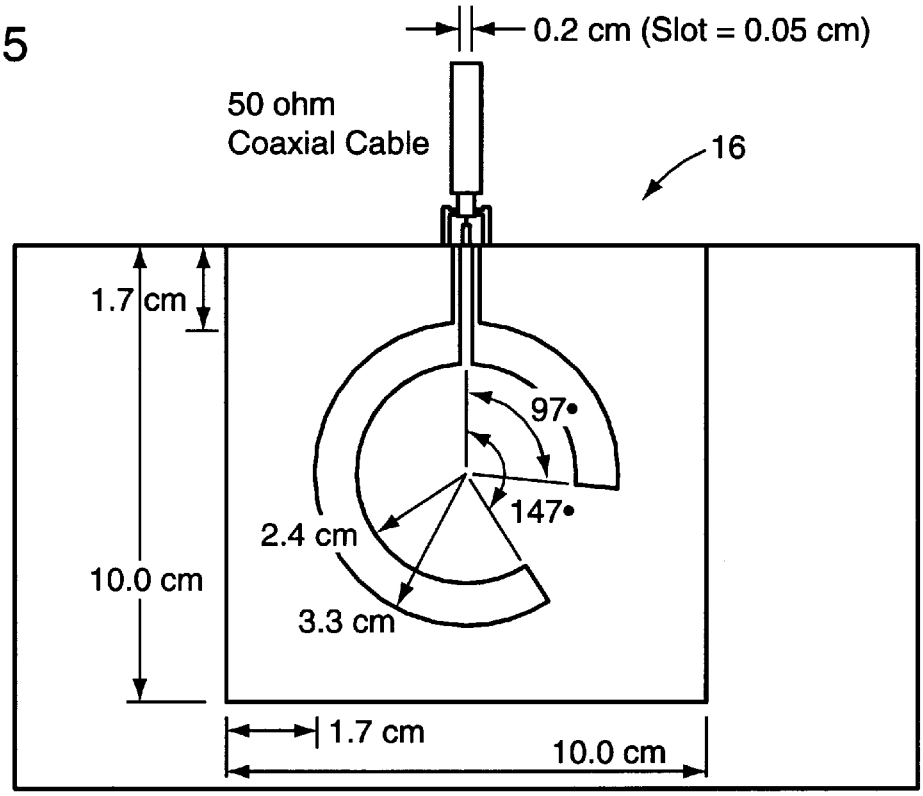
FIG. 5 is a plan view illustrating the dimensions of a preferred embodiment of the invention.

FIG. 5 illustrates the preferred antenna 16 and is labeled to show dimensions of the preferred embodiment.

The principal advantage of the present invention is that it combines the desirable antenna electrical characteristics with physical component parts in a way that allows the antenna to be easily incorporated into existing windshields or other transparencies using existing manufacturing processes, and easily connected by conductive connections in conventional manners to the GPS and cellular telephone circuitry. The antenna also provides a single antenna structure for serving both the cellular frequencies at approximately 900 MHz, and simultaneously serving the GPS frequencies at approximately 1.575 GHz. It can also be used for other sets of frequencies which are sufficiently high to allow practically sized antennas. The antenna in the cellular telephone frequency band is preferably incorporated into the top portion of the windshield, which is most nearly horizontal to provide a substantially vertically polarized antenna in the cellular frequency band and simultaneously provide circular polarization at the GPS frequency band with a view of the sky approximately from horizon to horizon.

The frequencies of operation and the polarization are adjusted by changing the slot diameter, width, length and location. These physical dimensions are also, as known to those skilled in the art, dependent upon the electrical characteristics of the glass, other window layers or other nonconductive materials associated with the antenna.

The signals to and from the antenna at the cellular telephone frequencies and GPS frequencies are coupled between the coaxial cable and the telephone circuitry and GPS receiver by means of a signal splitter in order to provide separation of the signals. The signal splitter must be bi-directional for the telephones. It has been found desirable to use a three-section, m-derived filter, consisting of two half-pi matching sections and an m-derived T-section.

Figure 6:
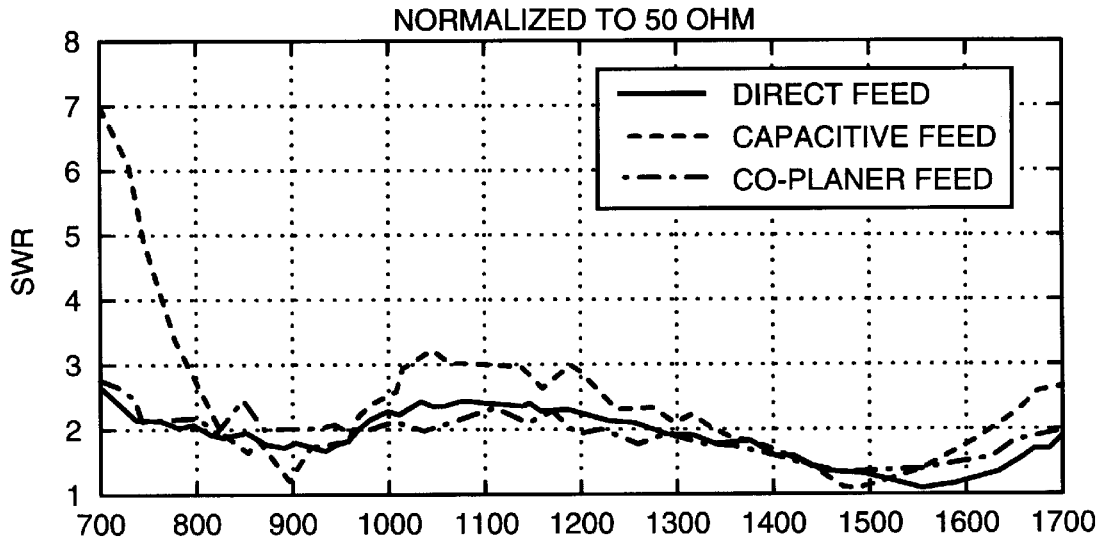
FIGS. 6 and 7 are graphs illustrating the frequency response of antennas similar to that shown in FIG. 5 embodying the invention.
Figure 7:
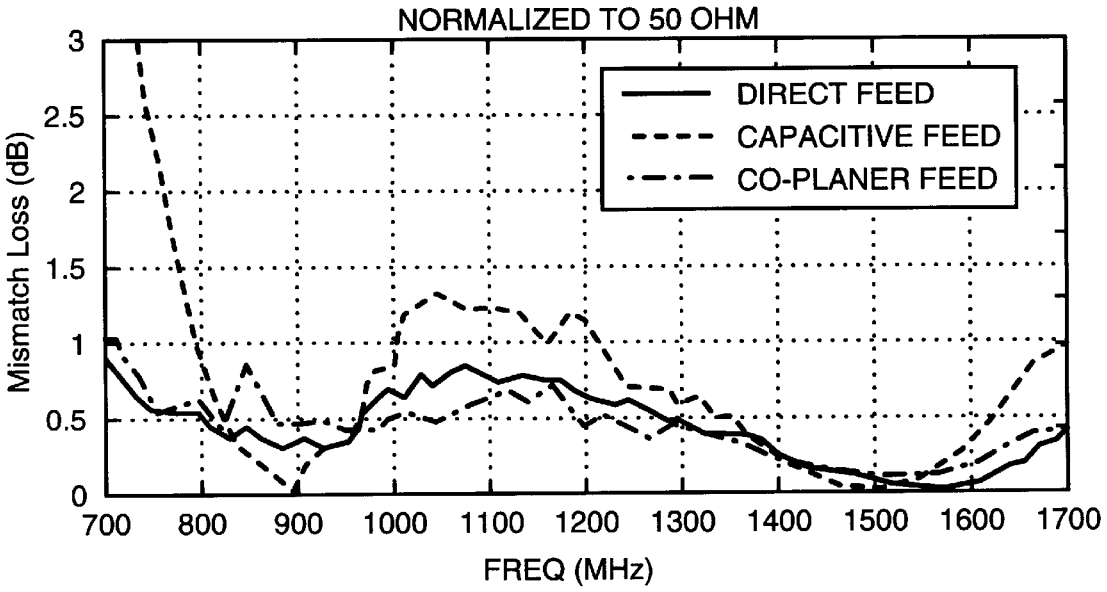

FIGS. 6 and 7 illustrate, by means of the mismatch loss and the standing wave ratio, the frequency response of the three antennas embodying the present invention fed with three alternative feed structures. These show the resonant curves at the desired frequency bands.

Figure 8:
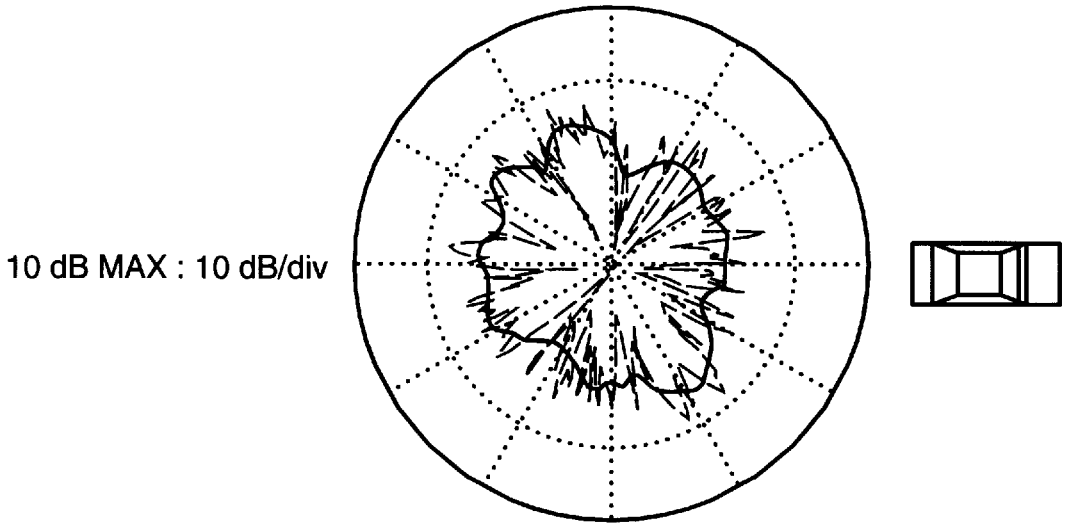
FIG. 8 is a graph illustrating a field strength pattern at cellular telephone frequencies of an embodiment of the invention.

FIG. 8 has a solid plot showing the relative amplitude of received signal for an antenna embodying the invention as a function of the direction of arrival at the antenna. This solid plot was derived from the raw data shown in FIG. 8 as a dashed line. These data were obtained at the cellular telephone frequency band with the antenna mounted on a vehicle which was driven in a large diameter circle. FIG. 8 demonstrates the omnidirectional characteristic of the antenna.

Figure 9:
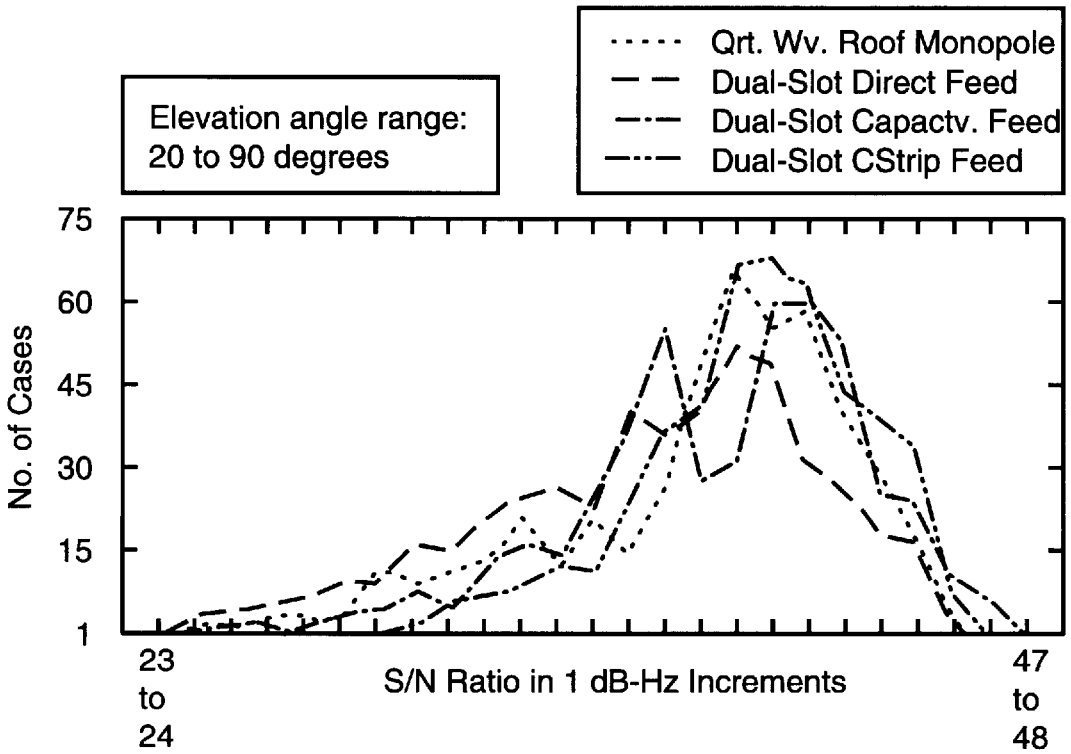
FIG. 9 is a histogram illustrating the distribution of GPS signals received having a signal to noise ratio between 23 and 48 for three different configurations of this antenna and for a reference antenna (monopole).

FIG. 9 is a histogram comparing three identical antennas embodying the present invention, each antenna fed in a different one of three different ways, to a quarter wave, roof mounted monopole antenna receiving a GPS signal. The horizontal axis represents the signal to noise ratio for each of a series of measurements, each being a case, with the vertical axis representing the number of cases. FIG. 9 illustrates that the signal to noise ratio provided by an antenna embodying the present invention is typically around 40.

Figure 10:
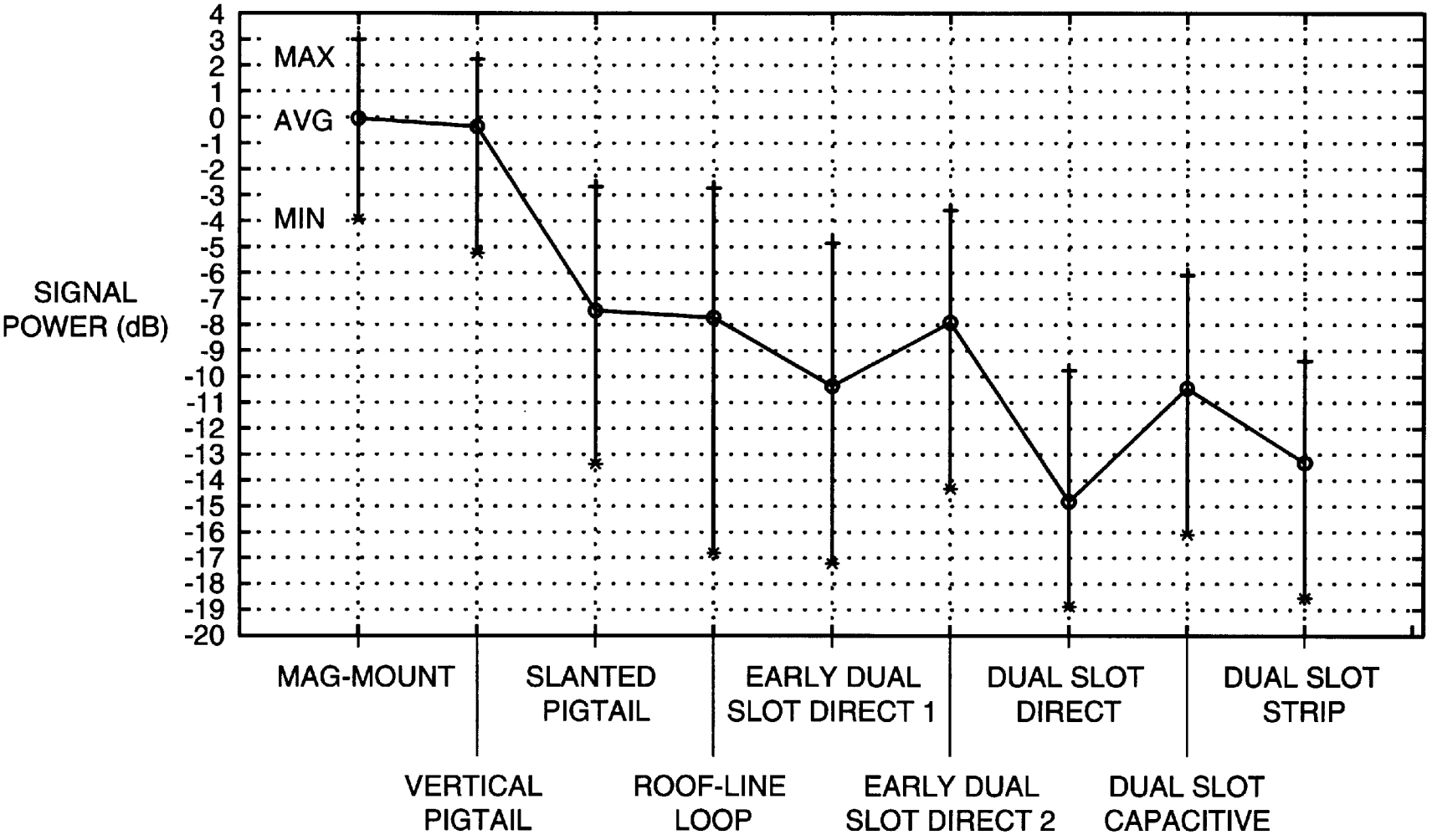
FIG. 10 is a graph comparing the signal strength of a variety of vehicle mounted antennas in the cellular frequency band.

FIG. 10 illustrates the comparative signal power for several different vehicle mounted antennas in the cellular band. The right-most three antennas are antennas embodying the present invention, fed in each of three different manners described above. FIG. 10 illustrates that, although embodiments of the invention which have so far been constructed do not provide gain equal to that of vertically extending conductors, the gain is comparable and competitive, particularly in view of the advantages they offer over such conventional antennas.

Figure 11:
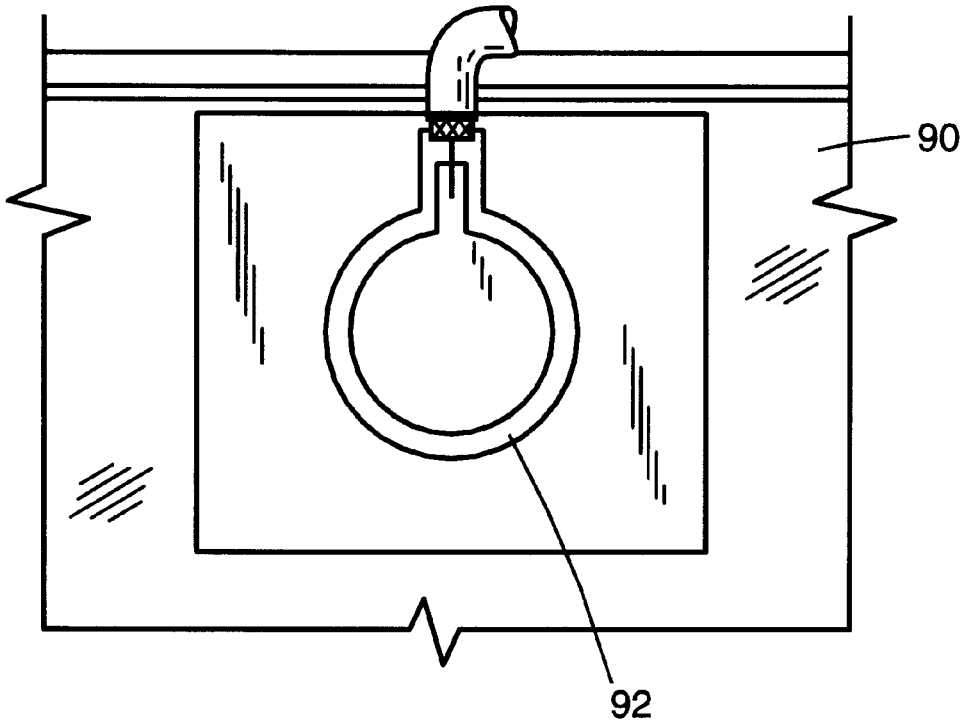
FIG. 11 is a plan view of an antenna formed in a sheet of conductive metal, such as a body panel of a vehicle.

FIG. 11 illustrates a slot antenna embodying the present invention but formed in a conductive sheet 90 such as a vehicle metallic body panel. The slot 92 has the same configuration and characteristics described above. However, the slot 92 is filled with a nonconductive material, such as plastic or fiberglass, so that the antenna presents a physical appearance which is aesthetically acceptable and so that the slot will not allow passage of dirt and moisture into underlying structures or apparatus.

While certain preferred embodiments of the present invention have been disclosed in detail, it is to be understood that various modifications may be adopted without departing from the spirit of the invention or scope of the following claims.

What is claimed is:

1. A dual band slot antenna comprising:

an electrically conductive layer bonded to a nonconductive panel and formed with a slot which forms the slot antenna having two slot legs extending in mutually transverse directions along nonperpendicular paths from a feed point, at which the legs join, to opposite slot leg ends, the slot legs having different lengths to provide resonance of the slot at two different frequency bands with substantially circular polarization at a higher frequency band and substantially vertical polarization at a lower frequency band.

2. An antenna in accordance with claim 1 wherein the slot legs have lengths to provide resonance at a global positioning system frequency band with circular polarization and also resonance at a cellular telephone frequency band with vertical polarization.

3. An antenna in accordance with claim 1 wherein the slot is formed along two adjoining arcs of the same circle extending oppositely from the feed point with a portion of the conductive layer interposed between the slot leg ends.

4. An antenna in accordance with claim 3 wherein the slot is tuned to a resonance at a global positioning system frequency band with circular polarization and also tuned to have a resonance at a cellular telephone frequency band with vertical polarization.

5. An antenna in accordance with claim 4 wherein the slot has an inner radius of substantially 2.4 cm, an outer radius of substantially 3.3 cm, a shorter one of the legs has an angular length of substantially 97 degrees from the feed point and a longer one of the legs has an angular length of substantially 147 degrees from the feedpoint.

6. An antenna in accordance with claim 1 or 2 or 3 or 4 wherein the nonconductive panel is a vehicle transparency having at least one layer and the antenna is coupled to a coaxial cable by a planar stripline formed by a strip of conductive film bonded to a surface of a layer of the transparency and extending outwardly from an interior edge of said slot at said feed point along and spaced within a gap in said conductive layer and connected to a conductor of a coaxial cable.

7. An antenna in accordance with claim 6 wherein the conductive layer is capacitively coupled to a grounded side of the coaxial cable.

8. An antenna in accordance with claim 7 wherein the transparency has a surrounding metallic, conductive frame and the conductive layer is spaced from the frame by a dielectric to form said capacitive coupling.

9. An antenna in accordance with claim 7 wherein a patch of conductive film is bonded to a different surface of a layer of said transparency so that a layer of said transparency forms a dielectric between said conductive layer and said patch, said patch being connected to said ground side of the coaxial cable.

10. An antenna in accordance with claim 1 or 2 or 3 or 4 wherein the nonconductive panel is a vehicle transparency having at least one layer and the antenna is coupled to a coaxial cable by a capacitively coupled stripline formed by a strip of conductive film bonded to a different surface of a layer of said transparency so that a layer of said transparency forms a dielectric between said conductive layer and said strip, said strip extending from a position spaced from and capacitively coupled to an interior portion of said slot outwardly to an edge of the transparency for connection to a conductor of the coaxial cable.

11. An antenna in accordance with claim 10 wherein the conductive layer is capacitively coupled to a ground side of the coaxial cable.

12. An antenna in accordance with claim 11 wherein the window has a surrounding metallic, conductive frame and the conductive layer is spaced from the frame by a dielectric to form said capacitive coupling.

13. An antenna in accordance with claim 12 wherein a patch of transparent, conductive, film is bonded to a different surface of a layer of said transparency so that a layer of said transparency forms a dielectric between said conductive layer and said patch, said patch being connected to said ground side of said coaxial cable.

14. A dual band slot antenna comprising:

an electrically conductive sheet formed with a slot having two slot legs extending in mutually transverse directions from a feed point, at which the legs join, to opposite slot leg ends, the slot legs having different lengths to provide resonance of the slot at two different frequency bands with substantially circular polarization at a higher frequency band and substantially vertical polarization at a lower frequency band.

15. An antenna in accordance with claim 14 wherein the slot is tuned to a resonance at a global positioning system frequency band with circular polarization and also tuned to have a resonance at a cellular telephone frequency band with vertical polarization.

16. An antenna in accordance with claim 14 wherein the slot is formed along two adjoining arcs of a circle extending oppositely from the feed point with conductive sheet interposed between the slot leg ends.

17. An antenna in accordance with claim 16 wherein the slot is tuned to a resonance at a global positioning system frequency band with circular polarization and also tuned to have a resonance at a cellular telephone frequency band with vertical polarization.

18. An antenna in accordance with claim 17 wherein the slot has an inner radius of substantially 2.4 cm, an outer radius of substantially 3.3 cm, a shorter one of the legs has an angular length of substantially 97 degrees from the feed point and a longer one of the legs has an angular length of substantially 147 degrees from the feedpoint.

19. An antenna in accordance with claim 1 wherein the legs are arcuate.

* * * * *